United States Patent [19]

McCoy

[11] Patent Number: 5,009,022

[45] Date of Patent: Apr. 23, 1991

[54] GUN SAFETY ASSEMBLY

[76] Inventor: Fred McCoy, 7050 N. Hwy. 1247, Science Hill, Ky. 42553

[21] Appl. No.: 490,884

[22] Filed: Mar. 9, 1990

[51] Int. Cl.[5] ..... F41A 35/00

[52] U.S. Cl. ..... 42/094; 42/106

[58] Field of Search ..... 42/7, 90, 106, 94

[56] References Cited

U.S. PATENT DOCUMENTS

| | | | |
|---|---|---|---|
| 706,697 | 8/1902 | Sims . | |
| 1,051,914 | 2/1913 | Prochnow | 42/85 |
| 1,069,623 | 8/1913 | Lutkens | 42/85 |
| 1,115,737 | 11/1914 | Prochnow | 42/85 |
| 1,308,665 | 7/1919 | Douglas | 42/7 |
| 1,818,329 | 8/1931 | Horix . | |
| 2,614,355 | 10/1952 | Rogers et al. | 42/85 |
| 2,985,980 | 5/1961 | Broshous | 42/94 |
| 3,100,608 | 8/1963 | Goldfarb . | |
| 3,200,528 | 8/1965 | Christensen | 42/94 |
| 4,515,301 | 5/1985 | A'Costa . | |

FOREIGN PATENT DOCUMENTS

| | | | |
|---|---|---|---|
| 498977 | 1/1920 | France | 42/106 |
| 522141 | 3/1955 | Italy | 42/85 |
| 1664 | of 1909 | United Kingdom | 42/7 |
| 293339 | 7/1928 | United Kingdom . | |

*Primary Examiner*—Charles T. Jordan
*Assistant Examiner*—Richard W. Wendtland
*Attorney, Agent, or Firm*—John J. Posta, Jr.

[57] ABSTRACT

The gun safety assembly includes a hand gun, a reel bearing an elongated cord connected thereto and a spring connected to the reel for biasing the cord toward and around the reel. The device also includes a ring on the gun butt and a snap ring on the free end of the cord releasably connecting the gun and cord, and a loop on the reel releasably connecting it to a gun belt. The reel is in the form of an outer casing with a cord opening therein, a cord spool disposed for rotation in the casing on a spindle, one end of the cord being secured to the spool, and a spiral spring in the casing with one end thereof connected to the casing or spindle and the other to the spool so that as the spool rotates in a selected direction to pay out the cord, the spring biases the cord toward and around the spool. The spring, casing, spool, spindle, cord, ring and snap ring preferably are of metal. With this assembly, with the reel on the gun belt and cord attached to the gun, the gun can be drawn from a holster on the belt and fully extended, the spring tension on the cord acting as a gun brace, helping the user to steady and aim the gun. When and if the gun is released, as in a scuffle, or when it is dropped accidentally it automatically retracts toward the belt and cannot be stripped from the user, e.g., a police officer. The user can also jerk it away from another person who has grabbed it, merely by quickly turning away. Thus, the assembly prevents accidental loss of the gun and also prevents an adversary from stripping the gun away.

8 Claims, 2 Drawing Sheets

GUN SAFETY ASSEMBLY

BACKGROUND OF THE INVENTION

1. Field of the Invention

The present invention generally relates to safety devices and more particularly to an improved safety device for a gun.

2. Prior Art

Various types of safety locks have been devised for preventing the accidental firing of guns. Locked permanently installed gun cases are also used to prevent the theft of guns from homes, offices and the like. However, no suitable portable protective device has been devised for preventing the stripping, as by an assailant, of a gun from the hand of a law enforcement officer during an arrest, an investigation or the like. Many law enforcement officers have been injured or killed with their own guns by assailants when the guns were lost to such assailants during scuffles therewith. In fact, such instances stand high on the list of causes of death of law enforcement officers in the line of duty.

Many law enforcement guns are also accidentally dropped and lost from their holsters and from the hands of the officers during law enforcement action and are not subsequently recovered by the officer. Such guns are expensive and dangerous weapons and it is generally undesirable that they be later found and used by the general public, and perhaps lead to accidental injury.

Accordingly, there is a need for a portable gun safety device that will enable a law enforcement officer to readily draw and fire his or her gun, but will prevent that gun from accidentally becoming lost or from being forcibly stripped by an assailant either from the holster or from the officer's hand.

It would also be desirable if such a protective device were able to act as a brace for steadying the officer's gun so as to increase the officer's shooting accuracy, all without interfering with the easy and rapid drawing and use of the gun.

SUMMARY OF THE INVENTION

The improved gun safety assembly of the present invention satisfies all the foregoing needs. The assembly is substantially as set forth in the Abstract of the Disclosure. Thus, the assembly includes a hand gun, a reel bearing an elongated cord connected on one end to a gun butt and on the other end to a spring in the reel for biasing the cord into the reel. It further includes means, such as a loop, releasably connecting the reel to a law officer's gun belt.

The reel has an outer casing with an opening therein out through which the cord projects. A cord spool is rotatably mounted on a fixed spindle in the casing, one end of the cord is connected to the spool. A spiral spring is disposed in the casing with one end connected to the casing or spindle and the other to the spool, so that as the spool rotates in a given direction to pay out the cord, the spring is wound, biasing the cord toward the spool and casing.

When the gun is drawn from a holster on the belt to which the casing is connected by a loop, the spring tension on the cord acts as a firm brace in order to steady the shooting arm and help increase shooting accuracy. If and when the gun is released from the hand, as being knocked out of it in a struggle with an assailant, it is automatically retracted by the cord as the cord is wound up on the spool by the spring, pulling the gun toward the gun belt and the officer and away from the assailant. If the assailant grabs the gun during a struggle, it still can be ripped from the assailant's hand and automatically retracted to the officer, merely by having the officer quickly turn away from the assailant. The cord is of limited length, just sufficient to enable the officer to draw the gun and hold it at arm's length. One end of the cord is pinned in the casing.

If the gun is accidentally dropped as during foot pursuit of a thief, etc., it will not fall to the ground and be lost or damaged, but will automatically retract to the gun belt and be available for use by the officer. Since the gun normally sits butt up in the belt holster, the cord does not interefere either with its resting position in the holster or with the ability of the officer to quickly draw the gun from the holster and arm it.

The assembly is simple, inexpensive, durable, portable and efficient. Various further features thereof are set forth in the following detailed description and accompanying drawings.

DRAWINGS

DETAILED DESCRIPTION

Figure 1:
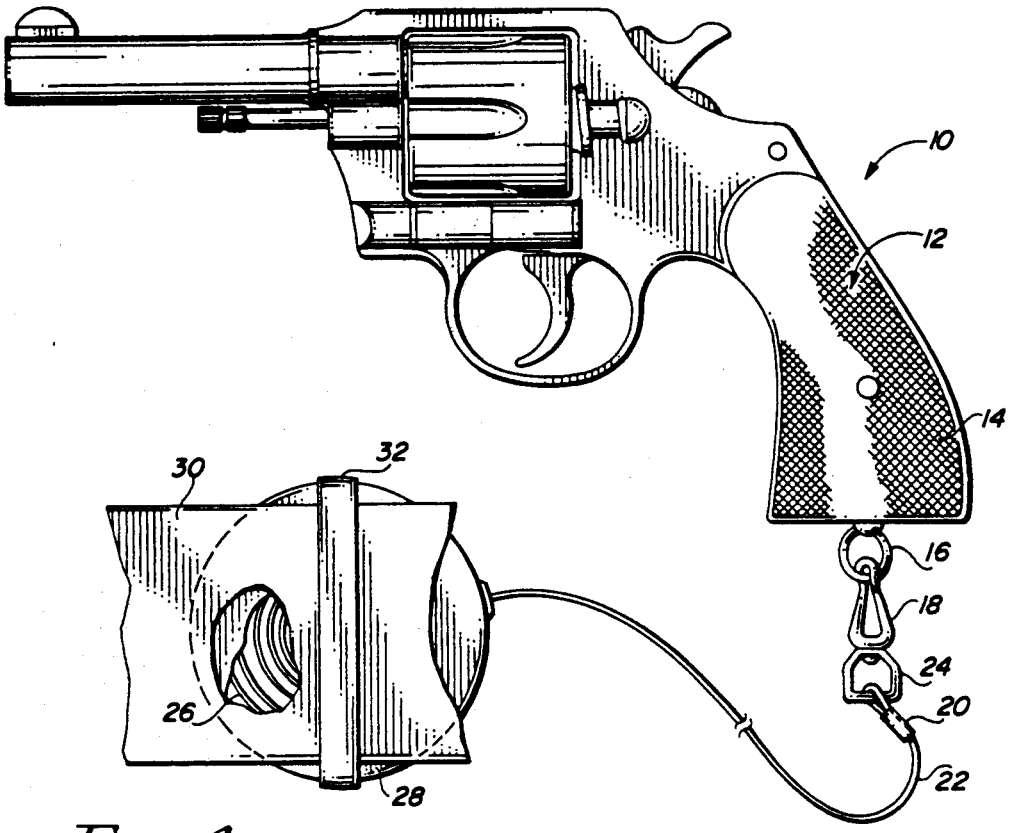
FIG. 1 is a schematic side elevation, partly broken away, of a first preferred embodiment of the improved gun safety assembly of the present invention.
Figure 3:
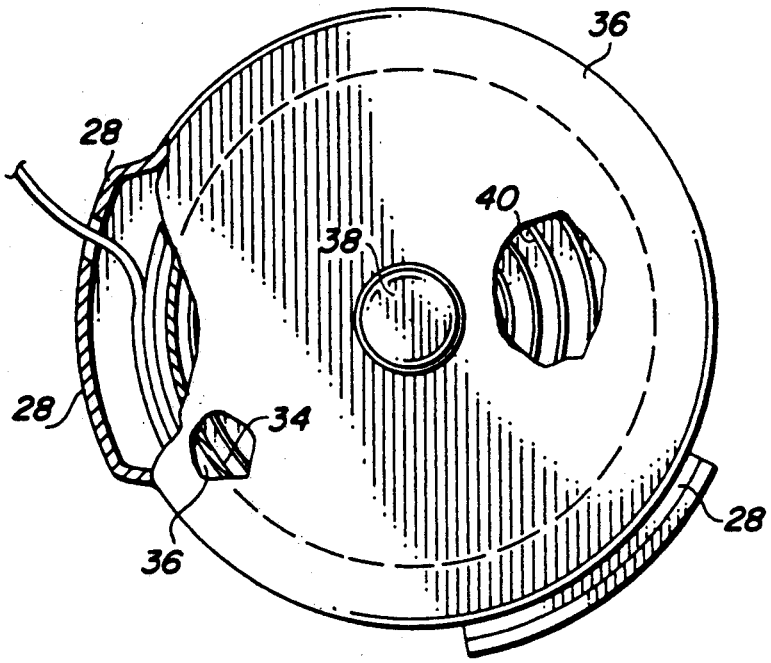
FIG. 3 is an enlarged schematic bottom plan view, partly broken away, of the spool, spring and spindle portion of the reel of FIG. 1; and, FIG. 4 is an enlarged schematic top plan view of the spool, spring and spindle of FIG. 3.
Figure 4:
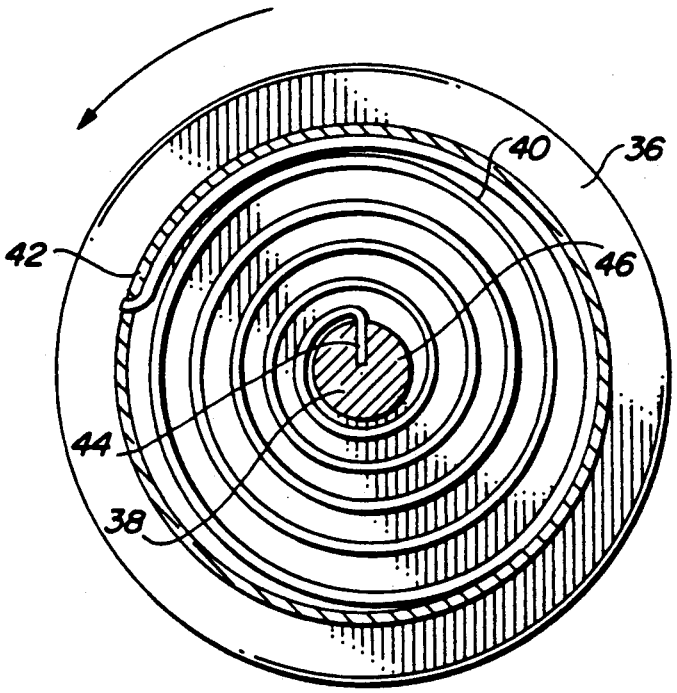

FIGURES 1, 3 and 4

Now referring more particularly to FIGS. 1, 3 and 4 of the drawings, a first preferred embodiment of the improved gun safety assembly of the present invention is schematically depicted therein. Thus, assembly 10 is shown. Assembly 10 comprises, in combination, a revolver 12, the butt 14 of which bears a connector ring 16 to which is releasably connected a snap ring 18 permanently affixed to the free end 20 of a cord or cable 22, as by a stirrup 24.

Cord 22 runs into the hollow interior 26 of a generally cylindrical closed casing 28 releasably held on a gun belt 30 by a loop 32 secured to the rear exterior of casing 28. As shown more particularly in FIG. 3, cord 22 is wound around the flanged peripheral rim of a circular cup-shaped open-topped spool 36 rotatably supported in interior 26 of casing 28 on a stationally spindle or rod 38. A spiral spring 40 such as is used in watches, clocks and the like is disposed in the open portion 42 of upper end 46 of spindle 38 while the opposite end 48 of spring 40 is connected to spool 36. As spool 36 rotates in the direction of the arrow in FIG. 4 when revolver 12 is drawn and extended to arms length, spring 40 biases it, eventually stopping the pay-out of cord 22 from spool 36 and providing the necessary spring tension for (a) automatically retracting cord 22 into casing 28 around rotating spool 36 when cord 22 and revolver 12 are released, and (b) for providing a desired tension on revolver 12 in the drawn position to enable an officer to hold it steady for more accurate firing of revolver 12. Thus, assembly 10 provides two separate safety functions which cooperate for more efficient and safer law enforcement.

It will be understood that any other suitable arrangement and configuration of the spring, spool, spindle, casing array of assembly 10 could be made, so long as it provided the above-described functions. Thus, for example, spring 40 could be above or below spool 36 in casing 28, and a safety lock (not shown) could be provided for casing 28 and cord 22. In any event, preferably, assembly 10 is of sturdy metal, except for belt 30. Cord 22 can be of braided steel, cable or the like. Casing 28, loop 32, spool 36, spindle 38 and spring 40 can also be of steel, iron, tetonium, brass, etc., for maximum strength and durability. Snap ring 10 could be welded shut to prevent it being forced open.

FIGURE 2

Figure 2:
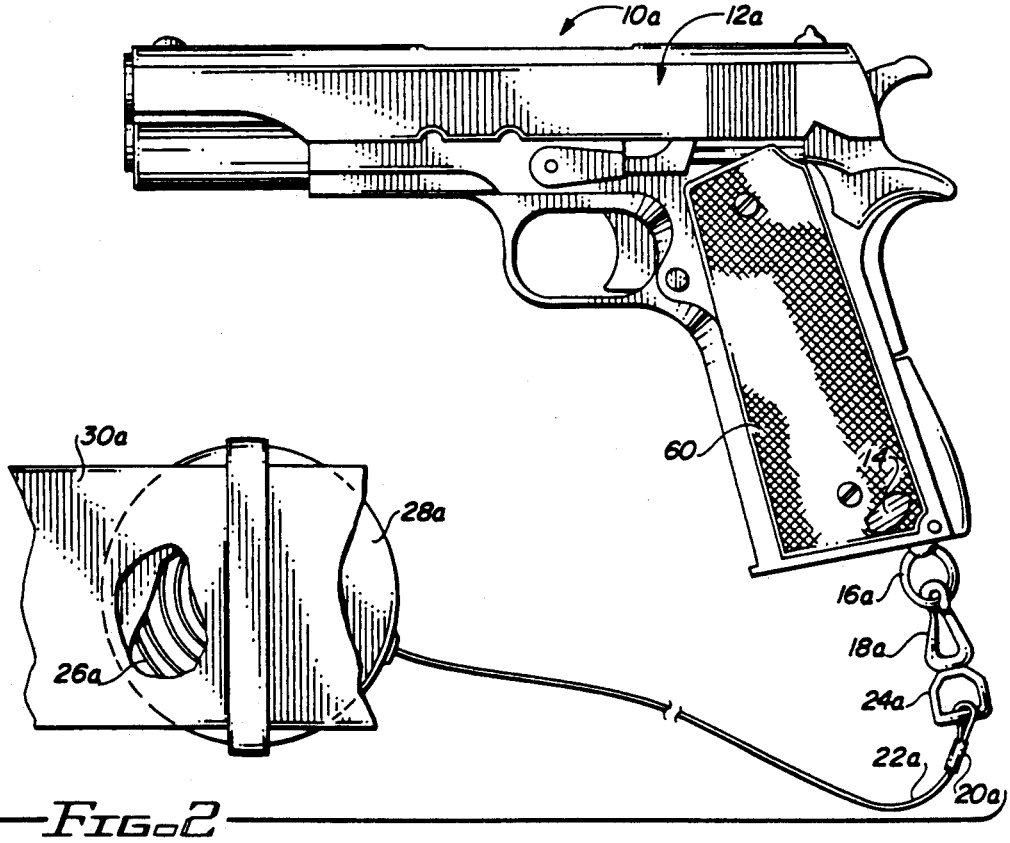
FIG. 2 is a schematic side elevation, partly broken away, of a second preferred embodiment of the improved gun safety assembly of the present invention.

A second preferred embodiment ofo the improved gun safety assembly of the present invention is schematically depicted in FIG. 2. Thus, assembly 10*a* is shown. Components thereof similar to those of assembly 10 bear the same numerals but are succeeded by the letter "a".

Assembly 10*a* is identical to assembly 10 except that revolver 12 is substituted for by an automatic hand gun 12*a* which has a custom grip 60 affixed thereto, which grip 60 bears ring 16*a* rather than 12*a* proper. Assembly 10*a* has the properties and advantages of assembly 10.

Various other modifications, changes, alterations and additions can be made in the improved gun safety assembly of the present invention, its components and their parameters. All such modifications, changes, alterations and additions as are within the scope of the appended claims form part of the present invention.

What is claimed is:

1. An improved gun safety assembly, said assembly comprising, in combination:

(a) a gun;

(b) a reel bearing an elongated cord and spring means biasing said cord toward said reel;

(c) means releasably connecting said reel to a gun belt;

(d) means releasably interconnecting said gun and said cord so that said gun when released from the hand, automatically moves toward said reel and belt with said cord for improved safety; and (e) wherein the length of said cord is just sufficient to extend said gun at arms length from said casing when on said gun belt and wherein the bias of said spring on said cord and gun is sufficient so as to help brace and steady said gun to assist accurate shooting thereof.

2. The improved assembly of claim 1 wherein said means releasably interconnecting said gun and said cord includes a ring connected to the butt of said gun and a snap ring connected to said free end of said cord, the opposite end of said cord being anchored to said reel.

3. The improved assembly of claim 2 wherein said means releasably connecting said reel to said gun belt comprises a belt loop rigidly secured to said reel.

4. The improved assembly of claim 3 wherein said reel includes an outer casing with a cord-receiving opening therein; a spool cord disposed for rotation on a spindle in said casing, with said cord wound around said spool and casing extending out said casing opening, and a spiral spring in the casing having two ends, one said end being connected to said casing or spindle and the other of said ends being connected to said spool, whereby said spool is biased into a cord-retracted position by said spring and wherein said cord, when pulled out of said casing, is biased by said spring toward retraction into said casing.

5. The improved assembly of claim 4 wherein said cord is steel cable, and wherein said casing, loop, spool, spring and spindle are metal, as are said gun ring and snap ring.

6. An improved gun safety assembly, said assembly comprising, in combination:

(a) a gun;

(b) a reel bearing an elongated cord and spring means biasing said cord toward said reel;

(c) means releasably connecting said reel to a gun belt;

(d) means releasably interconnecting said gun and said cord so that said gun when released from the hand, automatically moves toward said reel and belt with said cord for improved safety; and (e) wherein said means releasably interconnecting said gun and said cord includes a ring connected to the butt of said gun and a snap ring connected to said free end of said cord, the opposite end of said cord being anchored to said reel;

(f) wherein said means releasably connecting said reel to said gun belt comprises a belt loop rigidly secured to said reel;

(g) wherein said reel includes an outer casing with a cord-receiving opening therein; a spool cord disposed for rotation on a spindle in said casing, with said cord wound around said spool and casing extending out said casing opening, and a spiral spring in the casing having two ends, one said end being connected to said casing or spindle and the other of said ends being connected to said spool, whereby said spool is biased into a cord-retracted position by said spring and whereby said cord, when pulled out of said casing, is biased by said spring toward retraction into said casing;

(h) wherein said cord is steel cable, and wherein said casing, loop, spool, spring and spindle are metal, as are said gun ring and snap ring; and (i) wherein the length of said cord is just sufficient to extend said gun at arms length from said casing when on said gun belt and wherein the bias of said spring on said cord and gun is sufficient so as to help brace and steady said gun to assist accurate shooting thereof.

7. A method of preventing a law enforcement officer from losing his weapon to a criminal who might use it to harm the officer, comprising:

(a) providing a reel bearing an elongated cord and spring means biasing said cord towards said reel wherein the length of said cord is just sufficient to extend said gun at arms length from said casing when on said gun belt and wherein the bias of said spring on said cord and gun is sufficient so as to help brace and steady said gun to assist accurate shooting thereof;

(b) providing means for releasably connecting said reel to a belt of the officer; and, (c) interconnecting the weapon to said cord;

(d) whereby if the gun is released from the hand of an offer, it will automatically be retracted to the reel located on the officer's body.

8. An improved method of providing a brace for a person using a gun to steady the gun, comprising:

(a) providing a reel bearing an elongated cord and spring means biasing said cord towards said reel wherein the length of said cord is just sufficient to extend said gun at arms length from said casing when on said gun belt and wherein the bias of said spring on said cord and gun is sufficient so as to help brace and steady said gun to assist accurate shooting thereof;

(b) providing means for releasably connecting said reel to a belt of the person; and, (c) interconnecting the weapon to said cord;

(d) whereby said cord serves as a brace to steady the gun when being prepared for firing.

* * * * *